United States Patent [19]

Stegemoeller et al.

[11] Patent Number: 4,490,047

[45] Date of Patent: Dec. 25, 1984

[54] CONSTANT LEVEL ADDITIVE MIXING SYSTEM

[75] Inventors: Calvin L. Stegemoeller; Lonnie R. Walker, both of Duncan, Okla.

[73] Assignee: Halliburton Company, Duncan, Okla.

[21] Appl. No.: 474,615

[22] Filed: Mar. 11, 1983

[51] Int. Cl.[3] ..... B01F 15/02

[52] U.S. Cl. ..... 366/132; 366/136; 366/153; 366/237; 366/239

[58] Field of Search ..... 366/10, 30, 27–29, 366/43, 45, 46, 53, 54, 56, 92, 159, 131, 132, 136, 137, 142, 150, 151, 153, 154, 262, 161, 163, 176, 182, 185, 190, 191, 208, 219, 237–240; 222/64; 137/111, 112, 2

[56] References Cited

U.S. PATENT DOCUMENTS 646,994 4/1900 Janney ..... 366/237
4,165,186 8/1979 Tortorich et al ..... 366/153 X

OTHER PUBLICATIONS

Halliburton Services, Sales and Service Catalog, No. 41, p. 3838.

*Primary Examiner*—Timothy F. Simone
*Attorney, Agent, or Firm*—James R. Duzan; Thomas R. Weaver

[57] ABSTRACT

A mixing system comprising a movable mixing tub, a pumping source and a leveling valve interconnected to the mixing tub and the inlet or outlet of 10 the pumping source. The mixing system may include jet-type mixer to mix dry materials with fluid to be further mixed in the movable mixing tub.

17 Claims, 9 Drawing Figures

CONSTANT LEVEL ADDITIVE MIXING SYSTEM

BACKGROUND OF THE INVENTION

This invention relates to an improved control and mixing system for stationary or mobil equipment. More specifically, the invention relates to an improved control and mixing system for use in well servicing equipment.

It is desirable to have a reliable, self-maintaining fluid level control, simple to control, operate and maintain, and low cost and weight, and mixing system for stationary or mobil equipment, particularly, in well servicing equipment.

In the past, mixing systems in well servicing equipment have comprised jet-type mixers, recirculating type mixing systems and continuous blending equipment as described on respective pages 3839, 3838 and 3959 of Halliburton Services Sales and Service Catalog Number 41.

While the jet-type mixers, recirculating type mixing systems and continuous blending equipment have proven to be satisfactory in a wide variety of applications, each has disadvantages. For instance, the jet-type mixer is manually operated and incapable of recirculating the mixing fluid while the recirculating type mixing system requires two centrifugal pumps in order to recirculate the mixing fluid and pump the fluid to another pumping source and is not a self-maintaining fluid level control and while the continuous blending equipment requires multiple pumps, manifolds and pumping, a blending tub and may not be self-maintaining.

STATEMENT OF THE INVENTION

The present invention is directed to a mixing system which is reliable, self-maintaining fluid level control, simple to control, operate and maintain, low cost and weight. The mixing system, in most simple form comprises a movable mixing tub, a pumping source and a leveling valve interconnected to the mixing tub and the inlet or outlet of the pumping source. The mixing system may include jet-type mixer to mix dry materials with fluid to be further mixed in the movable mixing tub.

BRIEF DESCRIPTION OF THE DRAWINGS

The present invention will be better understood when taken in conjunction with the following detailed description of the invention and drawings wherein.

DESCRIPTION OF THE INVENTION

Figure 1:
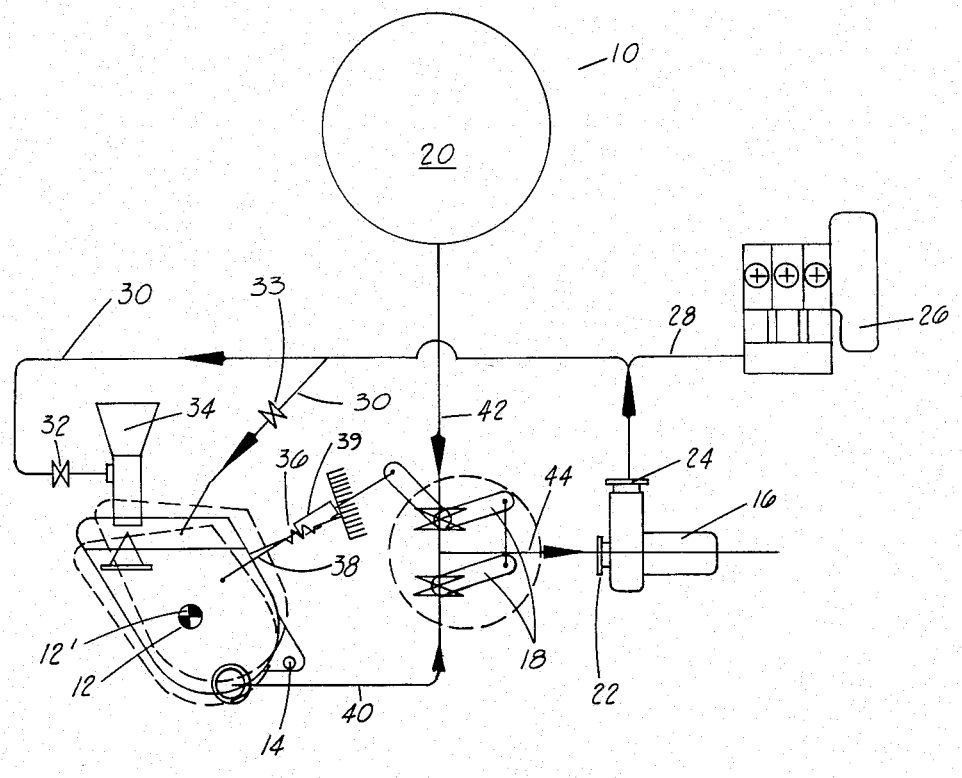
FIG. 1 is a schematic diagram of the mixing system of the present invention.

Referring to FIG. 1 a schematic diagram of an embodiment of the mixing system 10 of the present invention is shown.

The mixing system 10 of the present invention comprises a movable mixing tub 12 which pivots by way of resilient means 36 about axis 14 which is, in turn, offset from the center of gravity 12' of the tub 12, a pump means 16, and leveling valves 18 which control the flow of fluid from the mixing tub 12 and fluid tank 20 via fluid flow lines 40 and 42, respectively, forming common flow line 44 connected to the inlet 22 of the pump means 16. The outlet 24 of the pump means 16 is connected to a second pump means 26 and the mixing tub 12 via flow lines 28 and 30, respectively. Alternatively, a jet-type mixer 34 may be connected to the outlet of flow line 30 having valve means 32 therein to facilitate the mixing of dry materials in the mixing tub 12 or the outlet of flow line 30 having valve means 33 therein may exhaust directly into the tub 12. A adjusting means may be connected to the mixing tub 12 to control any vibratory motion of the tub 12.

The mixing tub 12 is interconnected via linkage 38 having adjusting means 39 therein to leveling valves 18 which control the flow of fluid to the inlet 22 of the pump means 16.

In operation, as the mixing tub 12 fills with fluid being pumped from the outlet 24 of the pump means 16 through flow line 30 into the tub 12, since the tub 12 is resiliently, pivotally mounted about axis 14 with the center-of-gravity 12' of the tub 12 offset from axis 14, as the tub 12 fills with fluid the tub 12 will resiliently pivot about axis 14. When the tub 12 resiliently pivots about axis 14, since linkage 38 connects the tub 12 to the leveling valves 18, any movement of the tub 12 about axis 14 will be transferred via linkage 38 to open or close the leveling valves 18 thereby controlling the flow of fluid from either the mixing tub 12 or tank 20 to the inlet 22 of pump means 16. The leveling valves 18 may be interconnected such that when one is being opened the other is being closed thereby keeping the fluid at a desired level in the mixing tub 12.

Any suitable type of resilient means may be utilized to cause the mixing tub 12 to resiliently pivot about axis 14. Suitable types of resilient means are torsion bars, coil springs, leaf springs, gas, air or hydraulic cylinders or any combination of the previously mentioned devices, etc.

Also, the pump means 16 and 26 and the leveling valves 18 may be of any suitable type. Suitable types of pump means may be centifugal pumps, positive displacement pumps, etc., while a suitable type of leveling valve is a butterfly-type valve.

Figure 2:
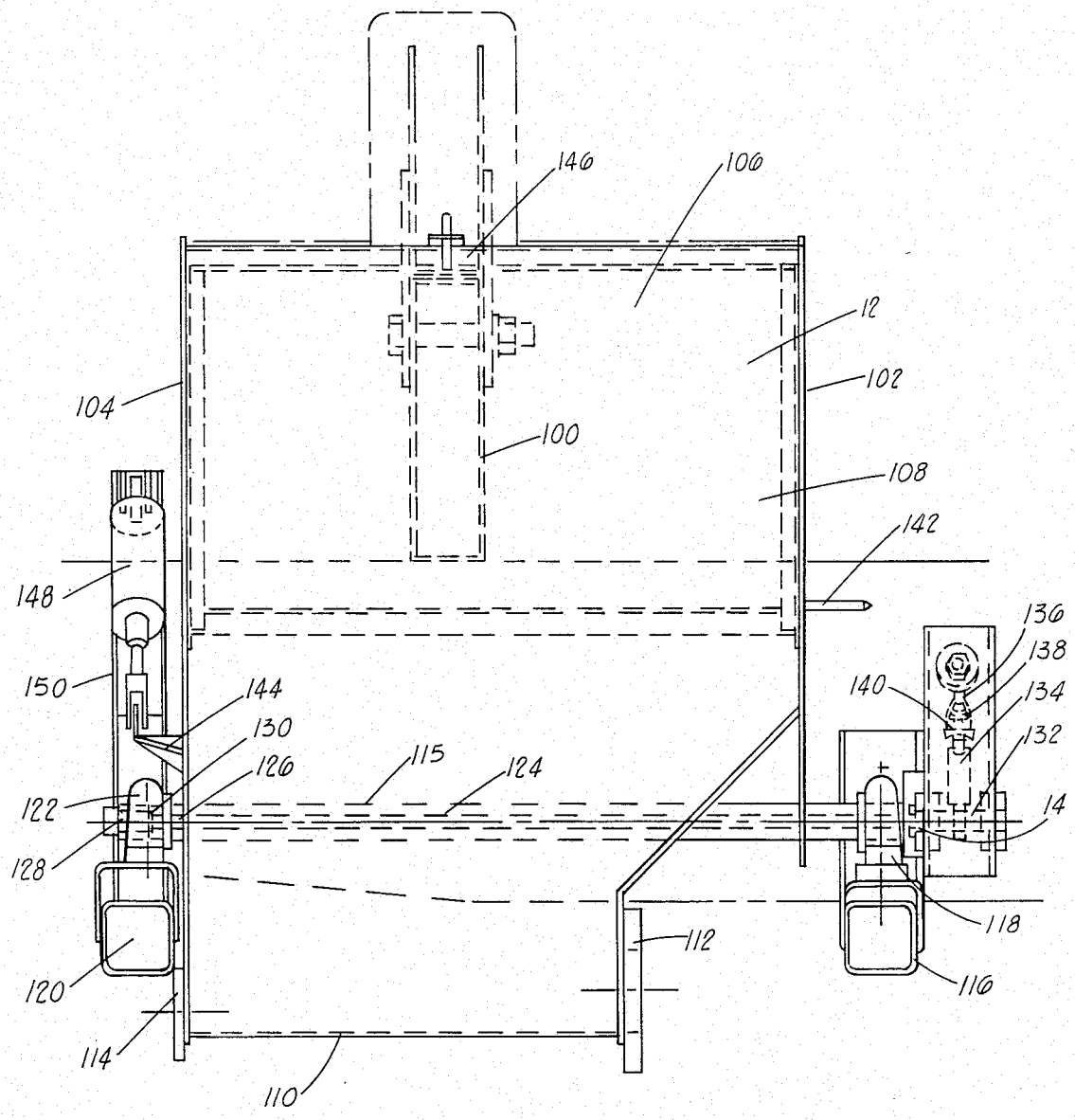
FIG. 2 is a side view of the mixing tub mounting arrangement of the present invention.

Referring to FIG. 2, a side view of a typical mixing tub 12 is shown as would be typically mounted for operation.

The mixing tub 12 comprises front end 102, rear end 104, back side 106, front side 108, bottom 110, fluid outlet 112, fluid drain 114, and mounting or support tube 115. The mixing tub 12 is pivotally supported by support tube 115 being rotatably supported at its front end by front support bracket 116 having bearing block 118 thereon engaging one end of support tube 115 while rear support bracket 120 having bearing block 122 thereon engages the other end of support tube 115. The weight of the mixing tub 12 and any fluid contained therein is rotatably supported by the support tube 115 engaging front 118 and rear 122 bearing blocks which are secured to front 116 and rear 120 supports.

To resiliently bias the movement of mixing tub 12 about support tube 115 a torsion rod or bar 124 extends through the center of support tube 115 having hexagonal head 128 on one end 126 of the torsion bar 124 engaging a mating socket 130 which is secured to the end of support tube 115 while the other end 132 of the torsion bar 124 has one end of a link 134 secured thereto with the other end of the link 134 adjustably secured by means of threaded member 136 having adjusting nut 138 thereon to mounting bracket 140.

The mixing tub 12 further comprises valve actuator pin 142 on front end 102, bracket means 144 on rear end 104 and transport bracket 146 which is used to secure the tub 12 in a transport position for over-the-road travel.

Secured to bracket means 144 is one end of adjusting means, such as an adjusting means 148, such as an air cylinder, which has the other end thereof secured to a portion 150 of rear support 120.

Figure 3:
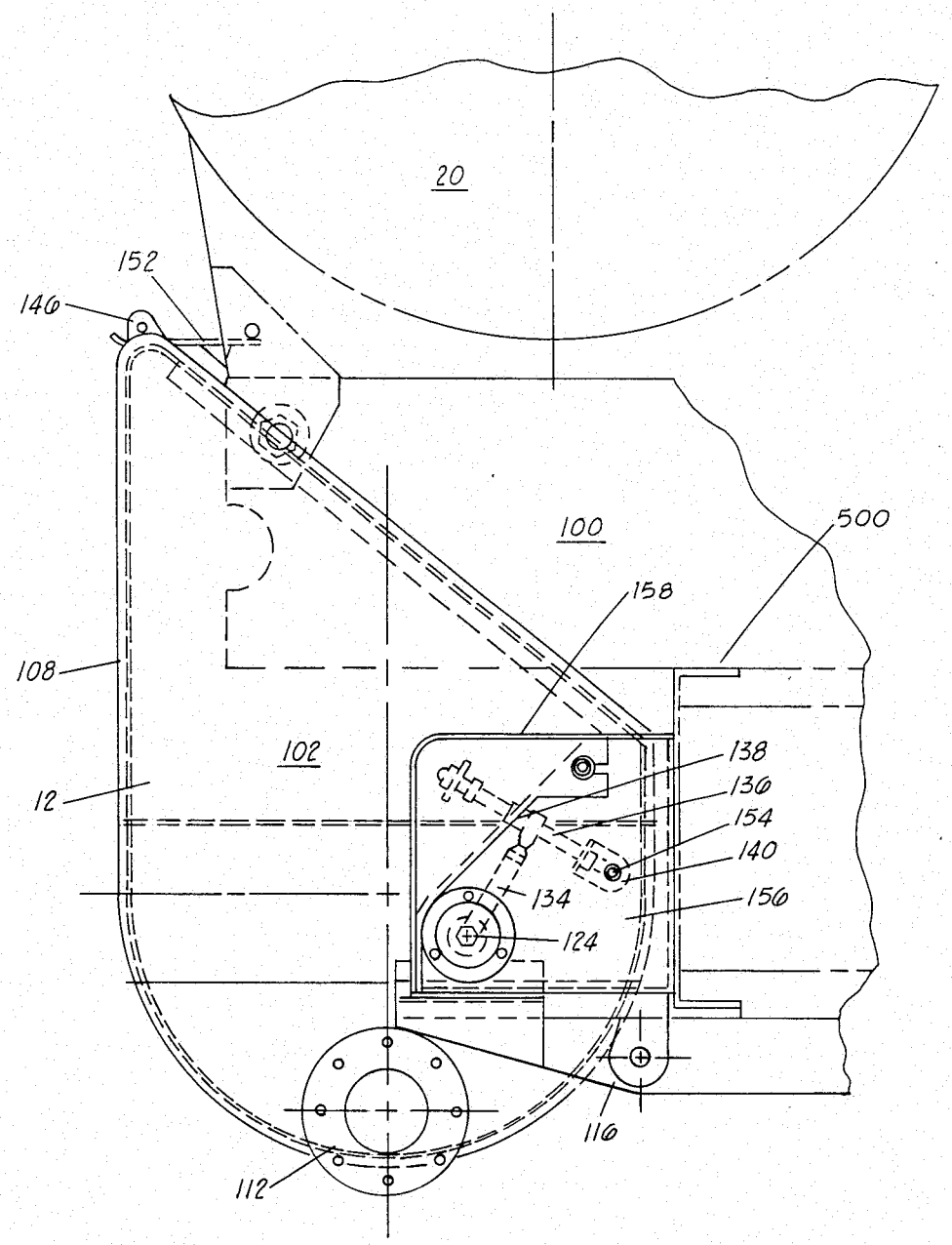
FIG. 3 is a view of one end of the mixing tub mounting arrangement of the present invention.

Referring to FIG. 3, the mixing tub 12 is shown looking at the front end 102. As in FIG. 2, the mixing tub 12 is shown in its transport position for over-the-road travel with transport bracket 146 engaging transport fastener 152.

The adjusting nut 138 on threaded member 136 is shown bearing against one end of link 134 which has the other end thereof secured to torsion bar 124. The mounting bracket 140 is secured via pin 154 to support 156 which is, in turn, secured to trailer frame rail 500. The support 156 includes a removable cover 158 to cover and protect link 134, threaded member 136 and adjusting nut 138.

Figure 4:
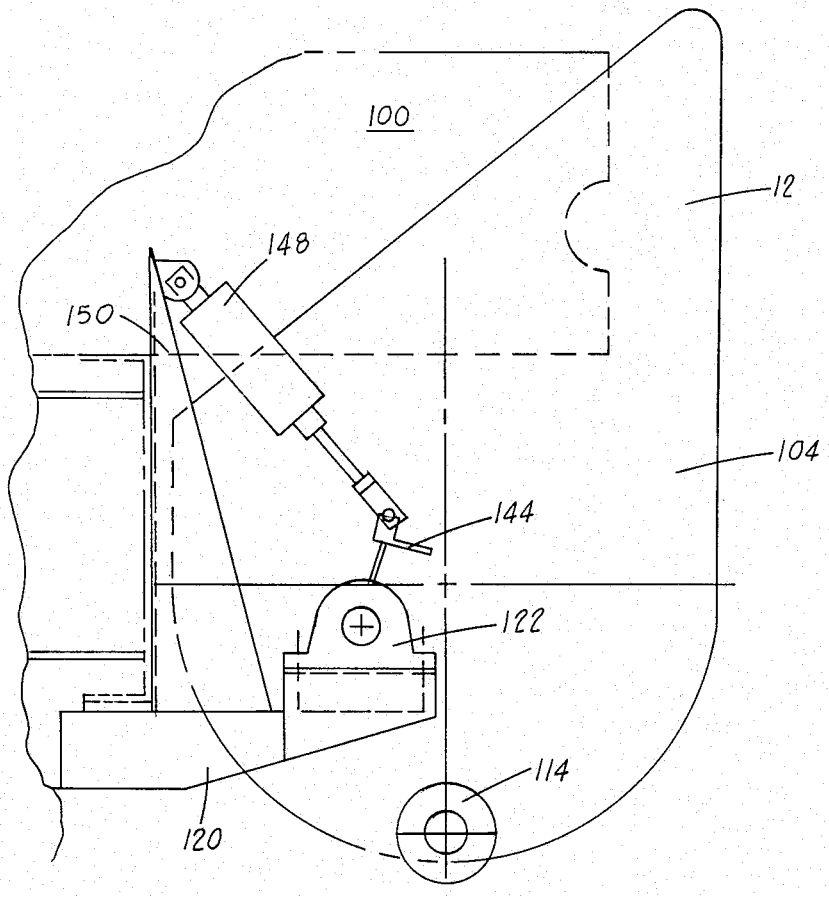
FIG. 4 is a view of the other end of the mixing tub mounting arrangement of the present invention.

Referring to FIG. 4, the rear end 104 of the mixing tub 12 is shown. The adjusting means 148 is shown having one end thereon secured to portion 150 of rear support 120 while the other end thereon is secured to adjustable bracket means 144 which is, in turn, secured to rear end 104 of the mixing tub 12.

As in FIGS. 2 and 3, the mixing tub 12 is shown in its over-the-road transport position, although transport bracket 146 and transport fastener 152 are not shown.

Figure 5:
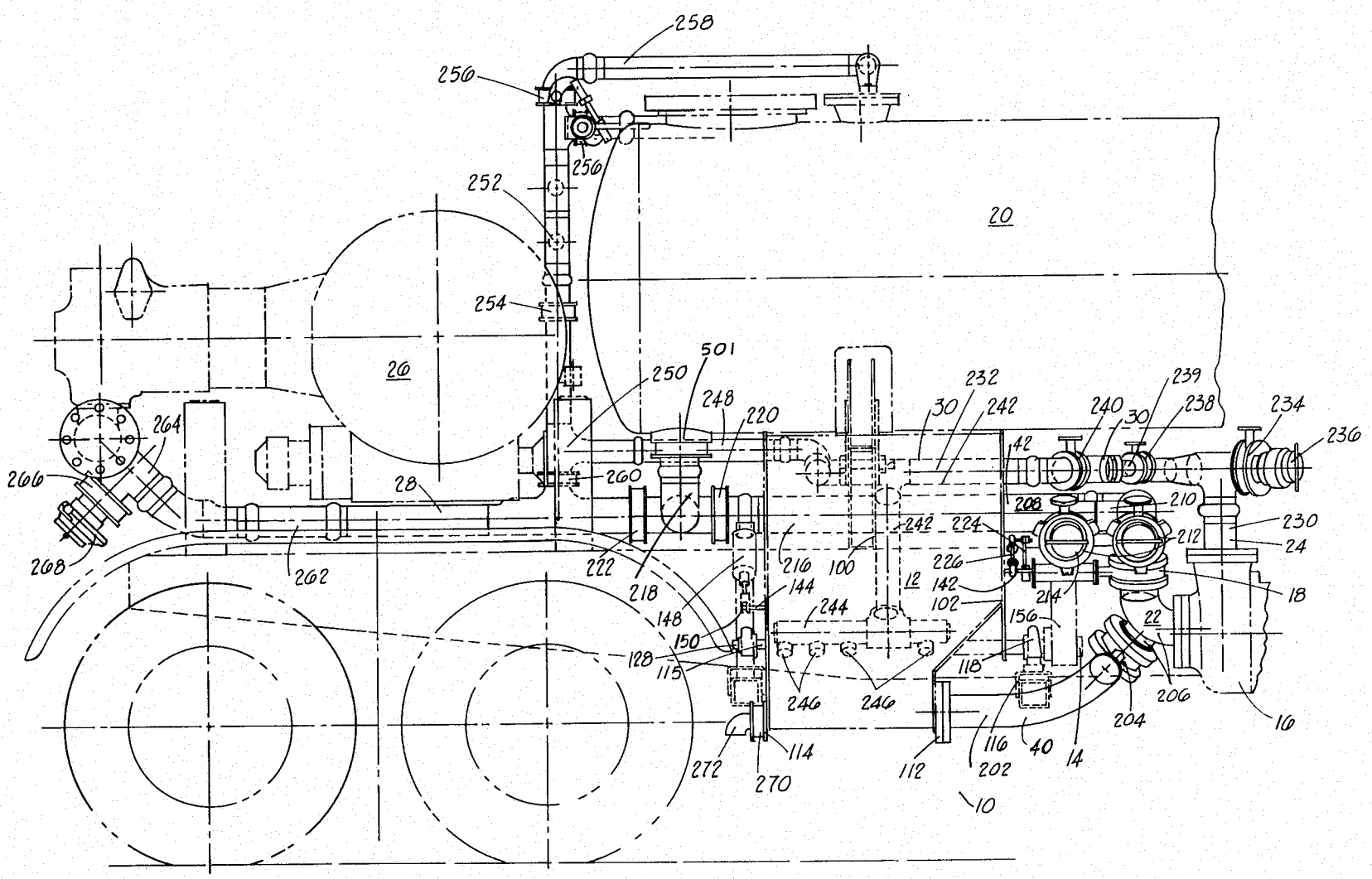
FIG. 5 is a side view of the mixing system of the present invention installed on mobil equipment.

Referring to FIG. 5, the mixing tub 12 is shown along with the associated pumping equipment, flow lines, valving and tanks forming the mixing system 10 installed on a mobile piece of equipment. As shown, the mixing tub 12 is in its transport position.

As shown, the outlet 112 of the mixing tub 12 is connected via flexible conduit 202 having valve means 204 therein, which form flow line 40, to the inlet 22 of the pump means 16. The inlet 22 of the pump means 16 comprises a branched flow line 206 having valve means 204 secured to an inlet portion thereof while leveling valve means 18 is secured to another inlet portion thereof with the outlet portion of inlet 22 being secured to the pump means 16.

The inlet to leveling valve means 18 is connected to flow line 42. The flow line 42 comprises a branched flow line 208 which includes header portion 210 having valve means 212 secured thereto which has, in turn, blank-off members 214 thereon, and main flow portion 216 which is connected via tank flow portion 218 to tank means 20. The main flow portion 216 includes valve means 220 between main flow portion 216 and tank flow portion 218 and valve means 222 connected to the aft end of main flow portion 216.

The leveling valve means 18 connected to branched flow line 206 of inlet 22 has its actuating level 224 thereof connected via adjustable link 226 to valve actuator pin 142 on the front end 102 of mixing tub 12.

The outlet 24 of pump means 16 comprises flow member 230 which connects pump means 16 to flow line 30.

The flow line 30 comprises a main flow line 232 having valve means 234 secured to one end thereof which has, in turn, cap means 236 secured thereto, valve means 238 connected to an intermediate portion of flow line 232 just aft of connection to outlet flow line 230 from pump means 16 which may have, in turn, a cap means secured to the outlet thereof, valve means 240 located therein aft of valve means 238, branch flow line portion 242, which extends into mixing tub 12, having flow header 244, in turn, connected thereto which has, in turn, flow outlets 246 thereon and aft flow portion 248.

Connected to the outlet of aft flow portion 248 of flow line 232 is the inlet of flow tee means 250. One of the outlets of flow tee means 250 is connected to the inlet of tank return flow line 252 which has valve means 254 and 256 therein and multiple outlet portions 258 connecting the tank return flow line 252 to one or more tank means 20. The other outlet of flow tee means 250 is connected to valve means 260 which is, in turn, connected to flow line 28. Flow line 28 comprises flow line 262 having one end thereof connected to valve means 222 while the other end is connected to suction header 264 which is, in turn, connected to the inlet of pump means 26. The suction header 264 has one or more valve means 266 having, in turn, blank-off member 268 connected thereto.

The outlet 114 of mixing tub 12 has valve means 270 connected thereto which has, in turn, flow line 272 connected to the outlet thereof.

Figure 6:
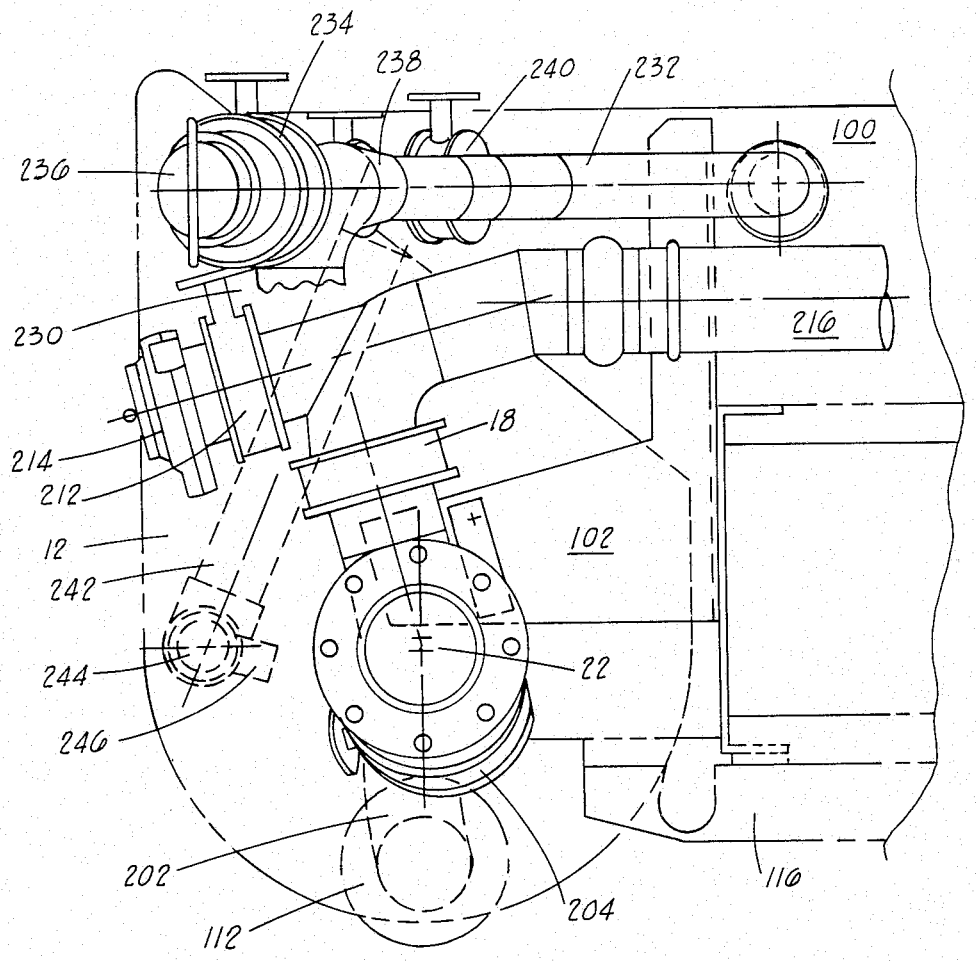
FIG. 6 is a view of one end of the mixing tub of the present invention showing the flow lines to and from the mixing tub.

Referring to FIG. 6, the front of the mixing tub 12 of the present invention is shown along with a partial showing of the flow lines and valving. As shown in FIG. 6, the mixing tub 12 is in its over-the-road transport position.

The branch flow line portion 242 of outlet flow line 230 having flow header 244 thereon extends into the mixing tub 12 such that the flow outlets 246 will cause any fluid flow exiting outlets 246 to be directed from the front 108 of the tub 12 to the rear 106 thereof to cause fluid circulation within the tub 12 during operation.

Figure 7:
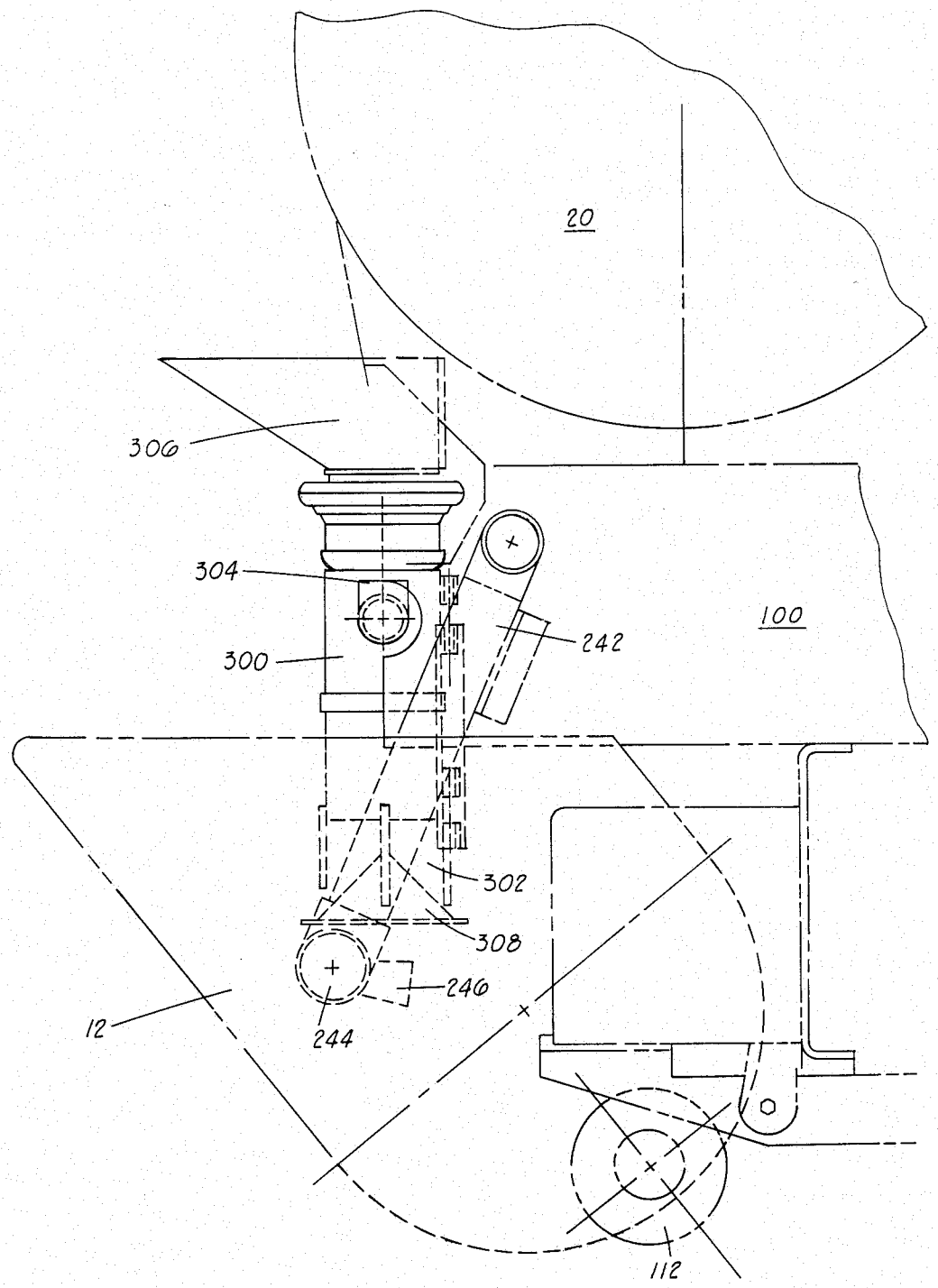
FIG. 7 is a view of one end of the mixing tub of the present invention showing a jet-type mixing device installed therein.

Referring to FIG. 7, the mixing tub 12 is shown in its operating position having a jet-type mixer 300 located therein. The jet-type mixer 300 is a type of mixer known as a 4×6 eductor, available from Halliburton Services, a division of Halliburton Company, Duncan, Okla. The eductor 300 is mounted from support 100 such that when the mixing tub 12 is in its operating position the bottom 302 of the eductor 300 extends over the portion of flow header 244 aft of branch flow line portion 242 to comingle the fluid flow from the eductor 300 with the fluid flow exiting outlets 246 on flow header 244. The eductor 300 includes fluid inlet 304 to which a flow line (not shown) is connected from the outlet of valve means 238 to provide fluid flow and a dry materials conveyor 306 into which dry materials are placed prior to mixing with the fluid entering the eductor 300 via fluid inlet 304. The mixture of fluid and dry materials exiting the bottom 302 of eductor 300 is deflected by the eductor hat 308 into the mixing tub 12.

OPERATION OF THE MIXING SYSTEM

Referring to FIG. 5, the operation of the mixing system 10 will be described.

In the first method of operation of the mixing system 10 fluid from the tanks 20 and any liquid or dry material which may be poured into the mixing tub 12 and adequately mixed therein will be described. In this method, valve means 212, 222, 234, 238, 254, 266 and 270 are in the fully closed position while valve means 204, 220, 240, 260 and 501 are in the fully open position.

When the various valve means are in the positions described above, fluid flows from the tanks 20 through flow line 42 into the inlet 22 of pump means 16 and fluid flows through flow line 40 into the inlet 22 of pump means 16 while fluid flowing from the pump means 16 flows through flow line 30 with a portion of the flow in flow line 30 flowing through branch flow line 242 into mixing tub 12 with the remainder of the flow flowing through main flow line 232 into flow line 28 to suction header 264.

When the mixing system 10 is operating in this fashion, the flow from fluid tanks 20 into the inlet 22 of pump means 16 is controlled by valve means 18 which is actuated via link 226 being connected to valve actuator pin 142 on mixing tub 12. Since the mixing tub 12 is resiliently biased to pivot about axis 14 which is concentric with the axis of support tube 115 of the mixing tub 12 having torsion bar 124 being connected thereto, as the fluid level in the mixing tub 12 increases, the tub 12 pivots outwardly and downwardly about axis 14 which causes the valve means 18 to be moved in a direction to reduce the flow of fluid from tanks 20 through flow line 42 into the inlet 22 of the pump means 16. The means by which the fluid level in mixing tub 12 may be controlled comprises link 134, threaded member 136 and adjusting nut 138. Since link 134 has one end thereof connected to torsion bar 124 while the other end is slidably connected to threaded rod 136 having adjusting nut 138 bearing against the end of link 134 slidably connected to rod 136, as adjusting nut is advanced along rod 136 in the direction of the mounting bracket 140 and pin 154 the torsion bar is stressed or rotates in a clockwise fashion, when viewed from the front of the mixing tub 12, causing the mixing tub 12 to be resiliently biased in a clockwise fashion about axis 14. When in operation, since the center-of-gravity 12' of the mixing tub 12 is offset from the axis 14 (see FIG. 1) as the mixing tub 12 fills with fluid the tub 12 will rotate in a counterclockwise direction about axis 14 while the torsion bar 124 resiliently biases the tub 12 in a clockwise fashion about axis 14 with the greater amount of stress on the torsion bar 124 causing a larger amount of fluid being required in the tub 12 to cause the tub 12 to rotate counterclockwise about axis 14 thereby causing the valve means 18 to be moved in a direction to restrict or limit flow from the tanks 20 into the inlet 22 of pump means 16.

When the flow of fluid from the tanks 20 is restricted or limited to the inlet 22 of pump means 16, the pump means 16 pumps more fluid from the mixing tub 12 via flow line 40 thereby reducing the amount of fluid in tub 12 until the torsion bar 124 moves the tub 12 in a clockwise direction about axis 14 thereby opening or moving valve means 18 in a direction to allow more flow from tanks 20 into the inlet 22 of pump means 18.

During or before operation, if the specific gravity of the fluid changes significantly, the torsion bar 124 can be assisted by resilient means 14 and system 10 will operate as described above.

When fluid is flowing out flow outlets 246 of flow header 244 in mixing tub 12, the fluid in tub 12 is caused to circulate in a counterclockwise fashion in tub 12, when viewed from the front thereof. By controlling the amount of fluid flowing through branch flow line 242 by way of the valve means 240 the mixing action or amount of circulation of the fluid in tub 12 may be controlled. Similarly, by restricting the flow through flow line 40 by way of valve means 204 the fluid level in tub 12 can be influenced.

Another method of operation of the mixing system 10 shown in FIG. 5 comprises mixing fluid and any desired dry materials in the mixing tub 12 and circulating the fluid mixture through the tanks 20 without pumping the fluid mixture 25 to the pump means 26. In this method of operation, valve means 212, 222, 234, 238, 260, 266 and 270 are in the fully closed position while valve means 204, 220, 240, 254, 256 and 501 are in the fully open position.

When the various valve means are in the positions described above, fluid flows from the tanks 20 through flow line 42 and through flow line 40, when the mixing tub 12 is filled with fluid, and into the inlet 22 of pump means 16 while fluid flowing from the pump means 16 flows through flow line 30 with a portion of the flow in flow line 30 flowing through branch flow line 242 into mixing tub 12 with the remainder of the flow flowing through main flow line 232 into flow line 252 and 258 to return to the tanks 20.

As described previously, when the mixing system 10 is operating in this fashion, the flow from fluid tanks 20 into the inlet 22 of pump means 16 is controlled by valve means 18 which is actuated via link 226 being connected to valve actuator pin 142 on mixing tub 12.

Since valve means 222 and 260 are in the fully closed position, when the mixing system 10 is operating in the manner described above, fluid is continuously recirculated through the tanks 20 and mixing tub 12 until the desired amount of dry materials have been mixed therewith and the desired properties of the fluid mixture having dry materials mixed therein has been obtained.

Once the fluid mixture in tanks 20 has the desired properties, valve means 260 may be opened and valve means 204, 240, 254, 256 may be closed to pump the fluid mixture to pump means 26 utilizing pump means 16. Once tanks 20 have been emptied valve means 220 may be closed and valve means 204 opened to empty the fluid mixture in mixing tub 12.

Alternatively, once the fluid mixture in tanks 20 has the desired properties, valve means 220 and 260 may be closed while opening valve means 222 to allow the fluid mixture to freely flow via flow line 262 to pump means 26.

Yet another method of operation of the mixing system 10 shown in FIG. 5 comprises mixing fluid and dry materials in the mixing tub 12 utilizing an eductor 300, not shown here but such as shown in FIG. 7, installed in the mixing tub 12. In this method of operation, valve means 212, 222, 234, 254, 256 and 266 are in the fully closed position while valve means 204, 220, 238, 240 and 260 are in the fully open position.

The eductor 300 is installed on support 100 in exhausting into the mixing tub 12 having a flow line (not shown) connecting the outlet 239 of valve means 238 to the fluid inlet 304 of the eductor 300.

When the various valve means are in the positions described above and an eductor 300 is installed exhausting into the mixing tub 12, fluid flows from the tanks 20 through flow line 42 and through flow line 40, when mixing tub 12 is filled with fluid into the inlet 22 of pump means 16 while fluid flowing from the pump means 16 flows through flow lines 30 and 28 to pump means 26 with a portion of the flow in flow line 30 flowing through branch flow line 242 into mixing tub 12 via flow lines 232 and 242 and a portion of the flow in flow line 30 flowing through valve means 238 via a flow line (not shown) connected to be fluid inlet 304 of the eductor 300 (not shown).

By using an eductor 300 to mix dry materials into the fluid, other than merely dumping or pouring the dry materials into the mixing tub 12, mixing of certain types of dry materials into the fluid may be accomplished more efficiently, in some instances.

It should be recognized that the mixing system 10 depicted in FIG. 5 may be operated in numerous other manners than those described hereinbefore which manners are obvious to one of ordinary skill in the art and fall within the scope of Applicants' invention.

Although the selection of the various components of the mixing system 10 is within the skill of the art, it is preferred that the valve means to be used in a low pressure mixing system be a butterfly-type valve means, such as described in U.S. Pat. Nos. 3,341,170; 3,420,498; 3,118,465; 3,589,678; 3,680,833; or 4,275,867.

Figure 8:
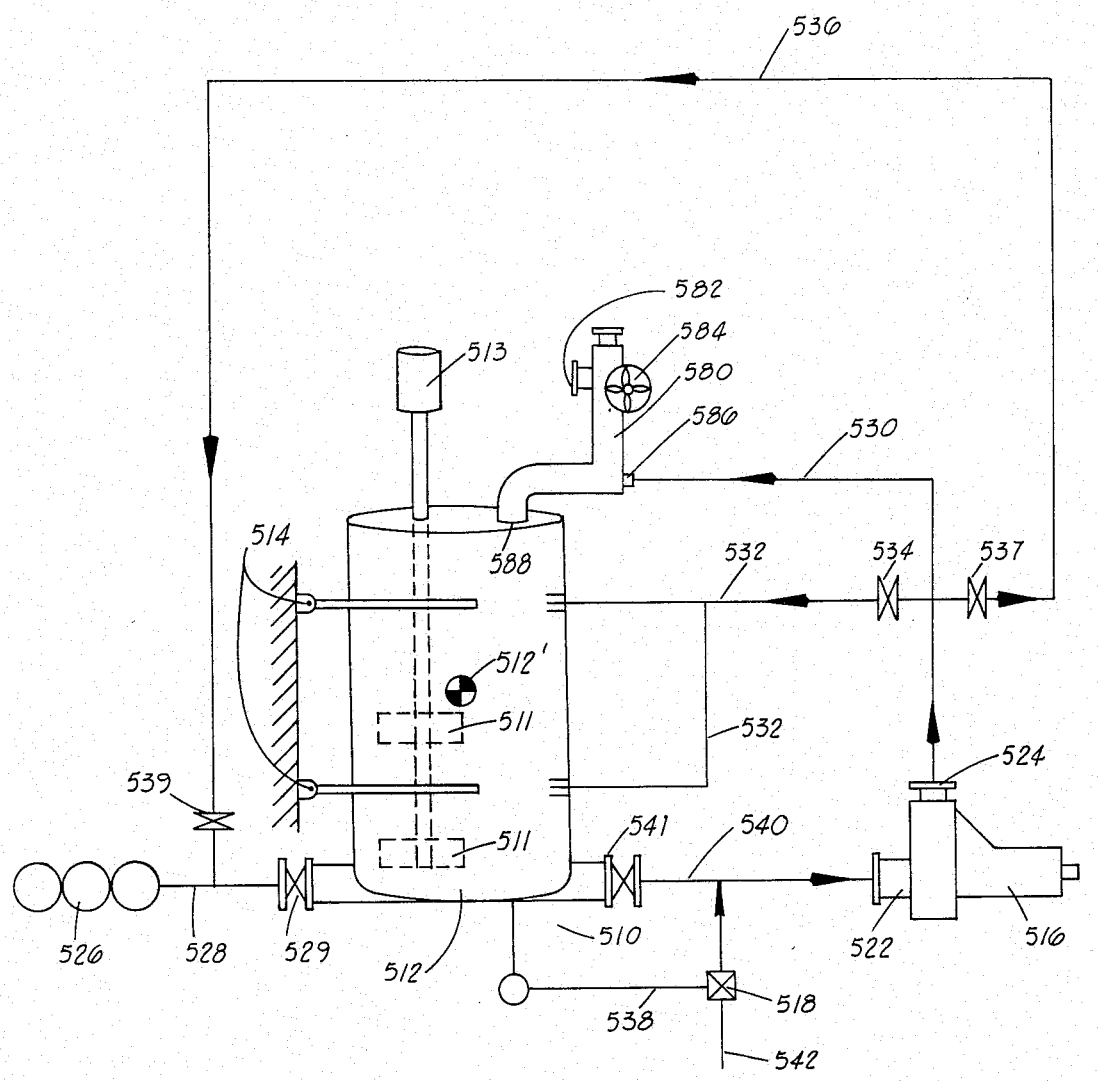
FIG. 8 is a schematic diagram of the mixing system of the present invention adapted for use with a mixing tub having agitators and a jet-type mixer installed therein.

Referring to FIG. 8, a schematic representation of a recirculating mixing system 510 which utilizes a mixer 512 having agitators therein, as described on page 3838 of Halliburton Services Sales and Service Catalog No. 41 is shown.

The mixer 512 is resiliently pivoted or mounted about axis 514 having the center of gravity 512' of the mixer 512 offset from the axis 514 in the manner shown. The mixer 512 contains agitators 511 therein which are powered by motor means 513 to agitate the fluid mixtures within mixer 512. The mixer 512 further includes jet-type mixer 580 which includes dry material inlet 582, dry material control valve means 584, fluid inlet 586 and fluid outlet 588 which empties into the interior of mixer 512. The jet-type mixer is of the type as illustrated on page 3839 of Halliburton Services Sales and Service Catalog No. 41.

The mixer 512 is divided into two mixing compartments with jet-type mixer 580 emptying into the first compartment which is connected via flow line 540 having valve means 541 therein to the inlet 522 of pump means 516 while the second compartment is connected via flow line 528 having valve means 529 therein to pump means 526.

Further conected to the inlet 522 of pump means 516 is fluid flow line 542 having leveling valve means 518 installed therein which controls the flow of unmixed fluid to the pump means 516. The leveling valve means 518 is connected via linkage 538 to mixer 512.

The outlet 524 of pump means 516 is connected via flow line 530 to jet-type mixer 580, via flow line 532 having valve means 534 therein to first compartments of mixer 512, and via flow line 536 having valve means 537 and 539 therein to flow line 528.

In operation, as the mixer 512 fills with fluid being pumped from the outlet 524 of the pump means 516 through flow lines 532 and/or 530, since the mixer 512 is resiliently pivotally mounted about axis 514 with the center-of-gravity 512' of the mixer 512 offset from axis 514, as the mixer 512 fills with fluid the mixer will resiliently pivot about axis 514. When the mixer 512 resiliently pivots about axis 514, since linkage 538 connects mixer 512 to the leveling valve 518, any movement of the mixer 512 about axis 514 will be transferred via linkage 538 to open or close the leveling valve 518 thereby controlling the flow of fluid to the inlet 522 of the pump means 516. If it is desired for some of the outlet flow from pump means 516 to bypass mixer 512, valve means 537 and 539 may be opened to allow flow through flow line 536.

Although the various components of the mixing systems 10 and 510 have been referred to as valve means, pump means, etc., any commercially available components which are suitable for operation in such a mixing system may be utilized.

It should be clearly understood that the mixing system illustrated in FIGS. 1 through 8 offers the advantages of automatic fluid level control in the mixing tub, only requires one pump to circulate and mix fluids in the mixing tub, is simple to operate and control, has a limited number of components for low weight and high system reliability, and/or may be used to boost or supercharge another pump.

It should be further understood that although the present invention has been described in relationship to a liquid-dry fluid mixing system, the present invention may be utilized in analogous types of systems, such as pneumatic conveying systems, etc.

Additionally, if so desired the mixing system illustrated in FIGS. 1 through 8 may utilize a second pumping means to pump fluid from the mixer 12 to the pumping means 26. If a second pump means is used, the outlet of pump means 16 is connected to valve means 18 to control the flow of fluid to mixer 12.

Figure 9:
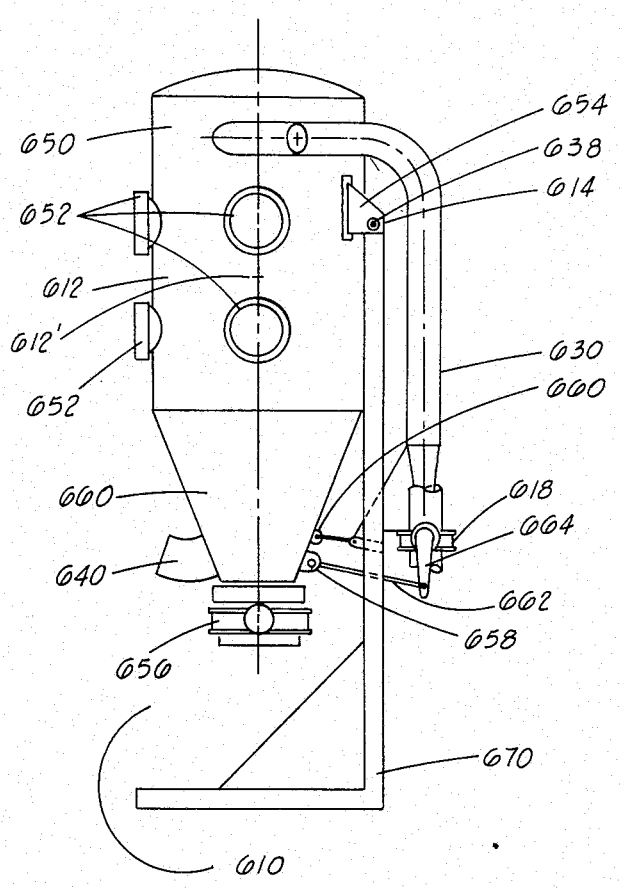
FIG. 9 is a mixing system of the present invention installed in a pneumatic conveying system.

Referring to FIG. 9, the self-leveling control of the mixing system is shown in pneumatic conveying system.

The mixing system 610 comprises a movable separator tank 612 which is resiliently pivoted about axis 614 by means of torsion bar 638 which axis 614 is, in turn, offset from the center-of-gravity 612' of the tank 612 and leveling valve 618 to control the flow of fluid to the tank 612.

The movable separator tank 612 comprises a cylindrical portion 650 having a plurality of sight glasses 652 located therein at various levels and inlet flow line 630 thereto, and a pair of mounting supports 654 having, in turn, a tube (not therebetween) and a frusto-conical portion 660 connected to cylindrical portion 650 having, in turn, fluid outlet 640, outlet valve 656 at the bottom thereof, valve link mount 658 thereon and shock absorber mount 660 thereon.

To support movable separator tank 612 a support frame 670 is utilized. The torsion bar 638 mounting arrangement between the support frame 670 and mounting support 654 having, in turn, a tube therebetween is similar to that of the mixing system 10 described in FIGS. 2 through 7 hereinbefore.

Connected to the inlet of flow line 630 is valve 618 which is actuated via link 662 having one end connected to valve actuating lever 664 of valve 618 while the other end is movably connected to link mount 658 on separator tank 612.

In operation, as particulate material is pneumatically conveyed into the movable separator tank 612 via flow line 630 since the tank 612 is resiliently pivoted about axis 614, as the tank fills with material it will rotate in a counterclockwise direction about axis 614 thereby causing the valve 618 to be actuated via link 662 in a direction closing the valve. When sufficient particulate material has flowed from the movable separator tank 612 via outlet 640, since the torsion bar 638 resiliently biases the tank 612 in a clockwise direction about axis 614, as the tank 612 empties it will rotate in a clockwise direction causing the valve 618 to be opened thereby increasing the flow of particulate material into the tank 612. To control the level of particulate material within the tank 612 the movable separator tension in the torsion bar 638 is merely increased so that the bar is placed in a more highly stressed condition thereby requiring a greater amount of particulate material to be contained in the tank 612 to actuate the valve 618.

Any suitable valve may be used for the valve 618, although a butterfly-type valve is perferred.

It should be understood that the system 610 described hereinbefore is merely illustrative of types of systems utilizing the present invention. Other systems not described hereinbefore but are contemplated by one of ordinary skill in the art utilizing the present invention are intended to be within the scope of the present invention.

Having thus described my invention I claim:

1. A mixing system for the mixing of materials by well servicing equipment used in well servicing operations and the like, said mixing system comprising:

tank means for use in the mixing of materials, the tank means having a fluid inlet and fluid outlet;

movable mixing tub means for use in the mixing of materials, the movable mixing tub means having a fluid inlet, fluid outlet and the center of gravity thereof offset from the axis about which the movable mixing tub means is movable;

pump means for use in the mixing of materials, the pump means having the inlet thereof connected to the fluid outlet of the tank means and the fluid outlet of the movable mixing tub means; and leveling valve means for use in the mixing of materials, the leveling valve means being disposed between the fluid outlet of the tank means and the inlet of the pump means, the leveling valve means interconnected to the movable mixing tub means such that movement of the movable mixing tub means is imparted to the leveling valve means to control the flow of fluid from the tank means to the inlet of the pump means.

2. The mixing system of claim 1 wherein the outlet of the pump means is connected to the movable mixing tub means.

3. The mixing system of claim 1 further comprising:

resilient means connected to the movable mixing tub means to cause the movable mixing tub means to be resiliently movable about the axis about which the movable mixing tub means is movable.

4. The mixing system of claim 3 further comprising:

adjusting means connected to the movable mixing tub means to adjust the amount of resilientcy in the resilient means.

5. The mixing system of claim 1 further comprising:

jet type mixing means for the mixing of dry materials and fluid having the outlet thereof emptying into the movable mixing tub means.

6. The mixing system of claim 1 wherein the movable mixing tub means includes movable agitator means therein.

7. The mixing system of claim 1 further comprising:

leveling valve means disposed between the fluid outlet of the movable mixing tub means and the inlet of the pump means, the leveling valve means interconnected to the movable mixing tub means such that movement of the movable mixing tub means is imparted to the leveling valve means to control the flow of fluid from the movable mixing tub means to the inlet of the pump means.

8. A mixing system for the mixing or storage of materials by well servicing equipment used in well servicing operations and the like, said mixing system comprising:

movable separator tank means for the mixing or storage of materials, the movable separator tank means having an inlet thereto, outlet therefrom, and the center of gravity thereof offset from the axis about which the movable separator tank means is movable;

rigid support means for movably supporting the movable separator tank means thereon; and leveling valve means for use in the mixing of materials, the leveling valve means being supported by the rigid support means, the leveling valve means interconnected to the inlet of the movable separator tank means such that movement of the movable separator tank means is imparted to the leveling valve means to control the flow to the inlet of the movable separator tank means.

9. The mixing system of claim 8 further comprising:

resilient means connected to the movable separator means and the rigid support means to cause the movable separator means to be resiliently movable about the axis about which the movable separator means is movable; and damping means connected to the movable separator means and the rigid support means to damp unwanted movements of the movable separator means from being transferred to the leveling valve means.

10. A self-leveling mixing system for the mixing of materials by well servicing equipment used in well servicing operations and the like, said self-leveling mixing system comprising:

tank means for use in the mixing of materials, the tank means having a fluid inlet and fluid outlet;

movable mixing tub means for use in the mixing of materials, the movable mixing tub means having a fluid inlet, fluid outlet and the center of gravity thereof offset from the axis about which the movable mixing tub means is movable;

resilient means connected to the movable mixing tub means to cause the movable mixing tub means to be resiliently movable about the axis about which the movable mixing tub means is movable;

first pump means for use in the mixing of materials, the first pump means having the inlet thereof connected to the fluid outlet of the tank means and the fluid outlet of the movable mixing tub means, and the outlet thereof connected to the fluid inlet of the movable mixing tub means, the fluid inlet of the tank means, and the fluid inlet of a second pump means; and leveling valve means for use in the mixing of materials, the leveling valve means being disposed between the fluid outlet of the tank means and the inlet of the pump means, the leveling valve means interconnected to the movable mixing tub means such that movement of the movable mixing tub means is imparted to the leveling valve means to control the flow of the tank means to the inlet of the first pump means.

11. The self-leveling mixing system of claim 10 wherein:

the resilient means connected to the movable mixing tub means comprises:

torsion bar means having one end secured to the movable mixing tub means and the other end adjustably secured to a portion of the support structure of the movable mixing tub means.

12. The self-leveling mixing system of claim 10 further comprising:

adjusting means connected to the movable mixing tub means to adjust the amount of resilientcy in the resilient means.

13. The self-leveling mixing system of claim 10 further comprising:

jet type mixing means for the mixing of dry materials and fluid having the outlet thereof emptying into the movable mixing tub means and the fluid inlet thereof connected to the outlet of the first pump means.

14. The self-leveling mixing systems of claim 10 wherein the fluid inlet of the movable mixing tub means comprises:

branch flow line means having flow header means secured thereto having a plurality of fluid outlets therefrom.

15. The self-leveling mixing system of claim 10 further comprising:

branched flow line means having the outlet thereof connected to the inlet of the first pump means and the inlet thereof connected to the outlet of the movable mixing tub means and the leveling valve means.

16. The self-leveling mixing system of claim 10 further comprising:

second pump means having the inlet thereof connected to the outlet of the first pump means.

17. The self-leveling mixing system of claim 10 further comprising:

dampening means connected to the movable mixing tub means to damp unwanted movements of the movable mixing tub means from being transferred to the leveling valve means;

jet-type mixing means for the mixing of dry materials and fluid having the outlet thereof emptying into the movable mixing tub means and the fluid inlet thereof connected to the outlet of the first pump means;

branch flow line means having flow header means secured thereto having a plurality of fluid outlets therefrom; and second pump means having the inlet thereof connected to the outlet of the first pump means.

* * * * *